United States Patent [19]

Horn

[11] 4,106,243

[45] Aug. 15, 1978

[54] SLOPED ROOF CONSTRUCTION FOR MODULAR BUILDING STRUCTURES

[75] Inventor: John J. Horn, El Toro, Calif.

[73] Assignee: PepsiCo Inc., Purchase, N.Y.

[21] Appl. No.: 762,283

[22] Filed: Jan. 25, 1977

[51] Int. Cl.[2] ..... E04H 1/00

[52] U.S. Cl. ..... 52/16; 52/22; 52/79.1; 52/94; 52/173 R

[58] Field of Search ..... 52/173, 11, 16, 79.1–79.14, 52/80, 22, 94

[56] References Cited

U.S. PATENT DOCUMENTS

| | | | |
|---|---|---|---|
| 315,977 | 4/1885 | Tufts | 52/16 |
| 2,691,291 | 10/1954 | Henderson | 52/11 |
| 3,090,162 | 5/1963 | Baroni | 52/80 |
| 3,200,026 | 8/1965 | Brown | 52/80 |
| 3,206,895 | 9/1965 | DeRidder | 52/80 |
| 3,280,518 | 10/1966 | White | 52/80 |
| 3,284,966 | 11/1966 | Bolt | 52/79.5 |
| 3,605,350 | 9/1971 | Bowers | 52/79.7 |

FOREIGN PATENT DOCUMENTS

| | | | |
|---|---|---|---|
| 115,150 | 9/1969 | Denmark | 52/79.1 |

*Primary Examiner*—John E. Murtagh
*Attorney, Agent, or Firm*—Scully, Scott, Murphy & Presser

[57] ABSTRACT

Roof arrangements for mobile modular building structures comprising a shallow depressed roof region of low slope confined within parapets, associated with drainage means at one end of the module also comprising utilities.

6 Claims, 6 Drawing Figures

SLOPED ROOF CONSTRUCTION FOR MODULAR BUILDING STRUCTURES

FIELD OF THE INVENTION

The present invention relates to a mobile modular building structure and, more particularly, a novel roof structure therefor.

DISCUSSION OF THE PRIOR ART

Mobile modular building structures are currently known in which one or more prefabricated housing modules, each constituted of a floor, upstanding walls, and a roof, are adapted to be transported to a predetermined location and there set into position. If desired, a number of such mobile building structures may be located in adjacent or contiguous relationship, or may be superimposed either vertically aligned or cantilevered so as to form a multi-storied building unit.

Each of the mobile modular building structures may be formed as a self-contained building element, having a dropped ceiling relative to the roof so as to define a space therebetween, and with the required air conditioning, heating plants, electrical power conduits, water and utility supply conduits, and so forth, being arranged within the space formed between the roof and the dropped ceiling. The particular components located in the space may then be readily connected to various sources of electrical or water supply.

In the prior art structures relating to mobile modular buildings, there is encountered the problem of providing adequate roof drainage to carry off rain water and the like, without such water flowing down the edges of the roof and causing smearing of the windows and upstanding wall portions.

SUMMARY OF THE INVENTION

Accordingly, it is an object of the present invention to provide a mobile modular building structure of the above-mentioned type which provides for improved facilities for drainage of any rain or water accumulating on the roof of the building structure.

Another object of the present invention is to provide a mobile modular building structure in which the drainage is effected in a predetermined manner so as to avoid streaking with water of the windows and side walls of the building structure by suitable channeling of the water accumulating on the roof.

Yet another object of the present invention is to provide a mobile modular building structure providing a planar upper roof surface having a predetermined downward slope extending from one end of the modular building structure towards the other end thereof, and with the lower end communicating with a downspout so as to provide drainage for any water or liquids accumulating on the roof of the building structure.

A still more specific object of the present dimension is to provide a mobile modular building structure of the above-mentioned type, in which the drainage is effected by having downwardly inclined slopes extending from the center of an upper planar roof surface towards the diametrically opposite end corners of the modular building structure, and having downspouts communicating with the aforementioned corner so as to provide drainage for the water or liquids accumulating on the roof of the building structure.

The foregoing and other objects of the invention are readily attained in that the roof of the mobile modular building structure is provided with encompassing parapets or low edges extending along the upper external edge of a generally horizontal roof structure, so as to thereby form a depressed planar upper roof surface therebetween, and with the upper roof surface sloping downwardly towards at least one of the opposite ends of the roof structure so as to thereby provide at least one drainage flow passageway for any water or liquid accumulated on the roof and extending towards the lower end of the roof structure.

In order to accomplish the foregoing, in one embodiment of the invention, the upper roof surface is sloped downwardly from the center thereof towards diametrically opposite ends of the roof, these ends being provided with scuppers, and with drainage downspouts communicating with the former.

In a preferred embodiment of the invention, the upper roof surface is sloped downwardly from one end edge thereof towards the longitudinal opposite end edge of the roof, the edge at the lower slope end being provided with a gutter extending therealong, and with at least one drainage downspout communicating with the gutter.

BRIEF DESCRIPTION OF THE DRAWINGS

Reference may now be had to the following detailed description of exemplary embodiments of a mobile modular building structure pursuant to the invention, taken in conjunction with the accompanying drawings; in which.

DETAILED DESCRIPTION

Figure 1:
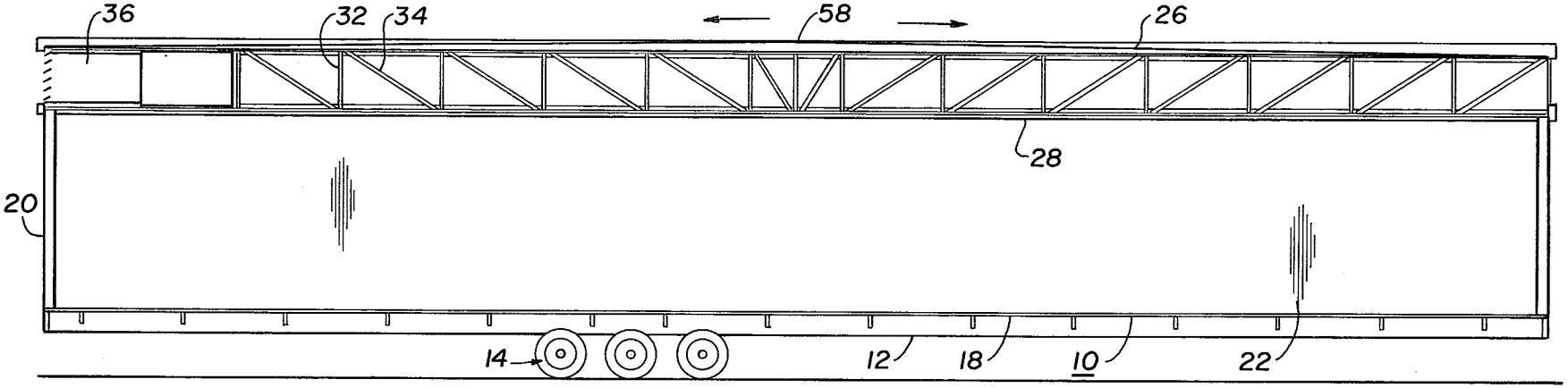
FIG. 1 shows a longitudinal elevational view, in section, of a mobile modular building structure pursuant to the invention.
Figure 2:
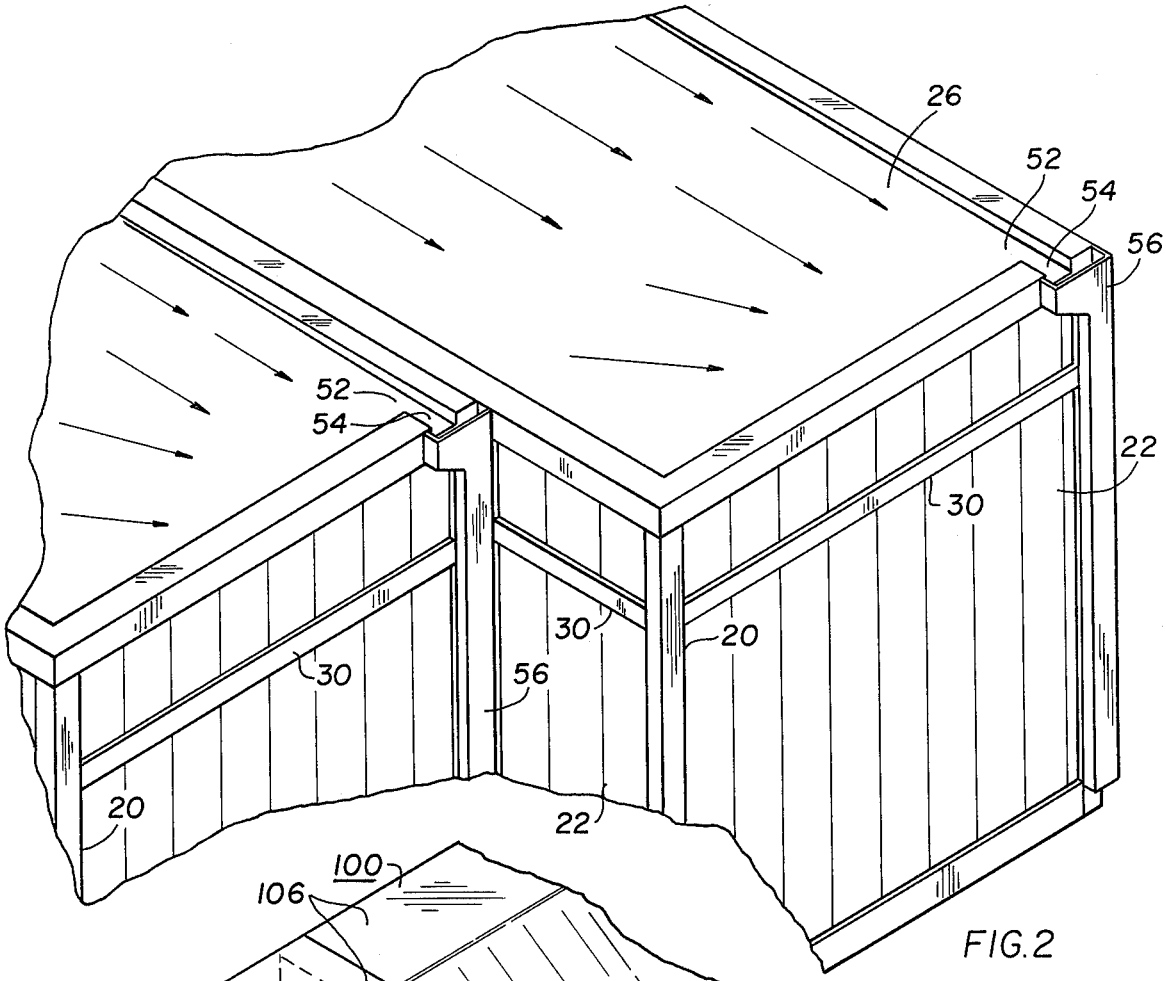
FIG. 2 shows an enlarged perspective end view of the mobile modular building structure.

Referring now in detail to FIGS. 1 and 2 of the drawings, a mobile modular building structure 10 is adapted to be transported to a predetermined location on its own multi-axled wheel structure 14 and adapted to be connected to a truck cab (not shown) by suitable means. This may include a "running gear" and A-frame hitch, designed to be pulled in tow by a "toter" or tractor, or truck cab.

Alternatively, the building structure 10 can be provided with a removable multi-axled wheel structure and adapted for attachment to a vehicle for transportation without need of a flat-bed truck.

The modular building structure 10 is of a prefabricated construction and includes a floor 18, a plurality of spaced upright support columns 20 between which there are located suitable wall members 22. Interiorly of the wall members 22 there may be provided suitable insulation 24 as shown in FIG. 4 of the drawings.

Supported on the upper ends of each column 20 is a roof structure 26 below which in spaced relationship is a dropped ceiling arrangement 28. The drop ceiling 28 may be laterally fastened to the upright columns 20 by means of horizontal beams 30. Suitable vertical spars 32 and cross beams 34 will provide a box-like stiffened structure between the drop ceiling 28 and the roof 26.

Adapted to be mounted in the space between the roof 26 and the drop ceiling 28 are heating and air conditioning units and ducting 36 and 38, as well as various water conduits and electrical cables (not shown), all of which may be connected to suitable sources of supply. Preferably, athough not necessarily, these heating and air conditioning units are located proximate one of the longitudinal ends of the modular building structure.

Figures 3, 4:
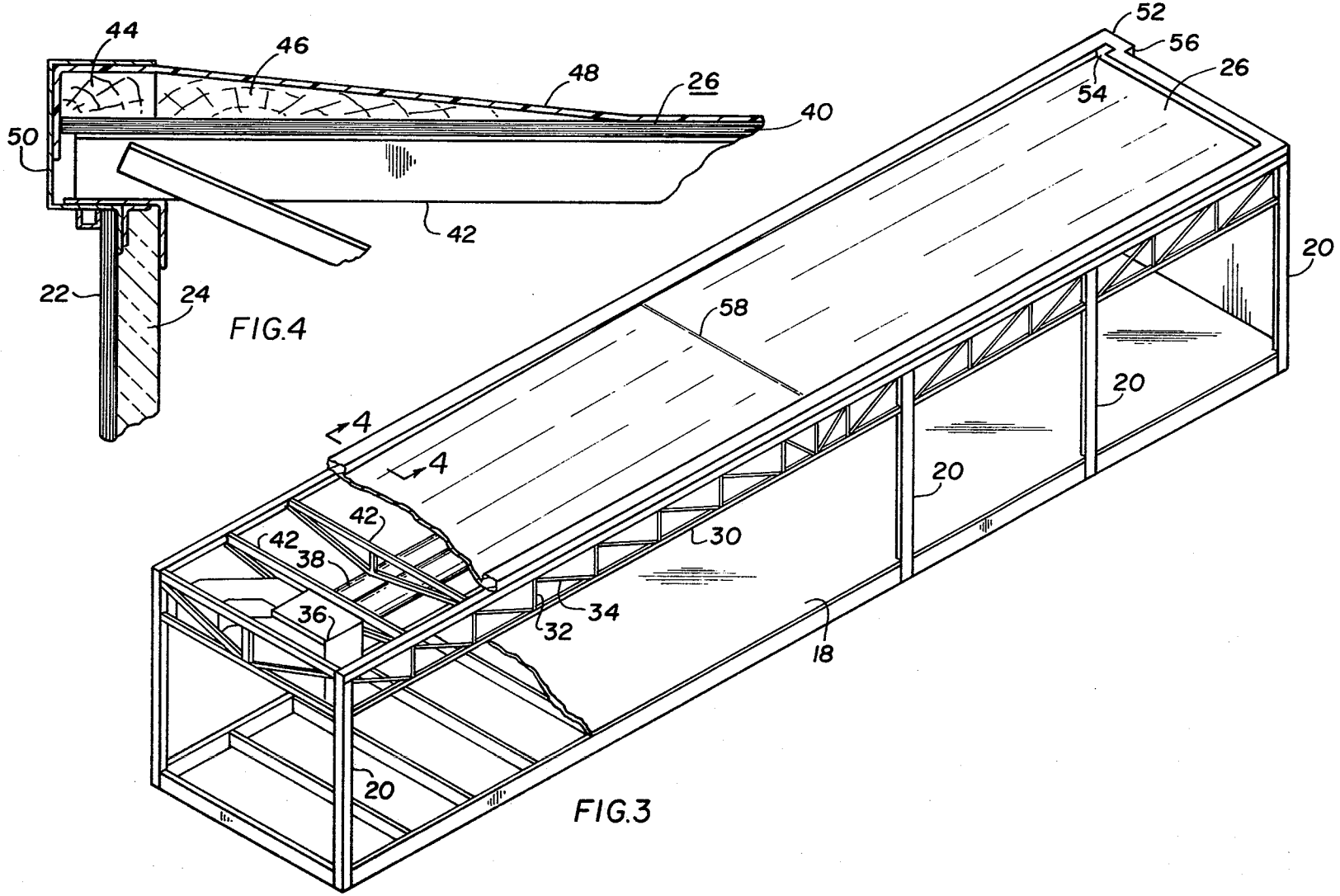
FIG. 3 shows a perspective view of the mobile modular building structure, with the side walls and part of the roof removed for purposes of illustration.
FIG. 4 shows an enlarged fragmentary section taken along line IV—IV in FIG. 3.

Reverting in greater particularity to the construction of the roof 26, as also shown in enlarged section in FIG. 4 of the drawings, the roof may consist of suitable laminated plywood 40 arranged in a generally horizontal position, and supported on cross beams 42. Parapets are formed along the edges of the roof by means of suitable wood blocks, adjacent which there may be located tapered wood members 46. The tapered wood members 46 and wood blocks 44 are covered by a plastic sheeting material, such as flexseal roofing material 48, which is of a moisture-impervious construction. The exterior ledges and ends of the plastic material 48 may be covered by suitable metal channel sections 50 extending along the edge of the roof 26. As may be clearly ascertained, the center portion of the roof is somewhat higher than the opposite ends thereof, in effect, tapering downwardly toward the latter by a drop of about two inches in elevation from the center of the roof towards diametrically opposite corners of the roof 26. These corners 52, as shown in FIGS. 2 and 3 of the drawings are provided with scuppers or drainage cutouts 54, the latter of which communicate with downspouts 56 to facilitate the ready drainage of any water or rain collecting on the roof 26. Since the roof slopes downwardly toward the diametrically directed corners 52 from center line 58, this will assure that any water or rain collecting on the roof 26 will flow in a divided flow path towards the diametrically opposite ends of the roof and there be readily drained off through the downspouts 56 without any flooding and overflow along the longitudinal edges of the roof, which would result in streaking of the wall and any windows contained therein.

The parapets formed along the edges of the roof are substantially in level configuration and also serve to permit stacking of the modular building structures. Located on the surface of the parapets is a plurality of locking mechanisms which lock the superposed modular structure to the base modular structure. Suitable locking mechanism is described in commonly assigned copending U.S. application Ser. No. 781,672 entitled "Modular Building Utilizing Fastening Devices," concurrently filed herewith, the disclosure of which is incorporated herein by reference.

From the foregoing, it thus becomes readily apparent that the entire mobile modular building structure may be prefabricated in a simple manner, including the roof having the required drainage configuration, and transported in toto to the desired building location.

Although the invention has been described with the surface of the roof sloping downwardly towards the diametrically opposite ends of the mobile modular building structure, within the scope of the present invention it is also possible that the roof be provided with a single slope extending downwardly from one end thereof towards the opposite end, and particularly one corner of that opposite end.

Figure 5:
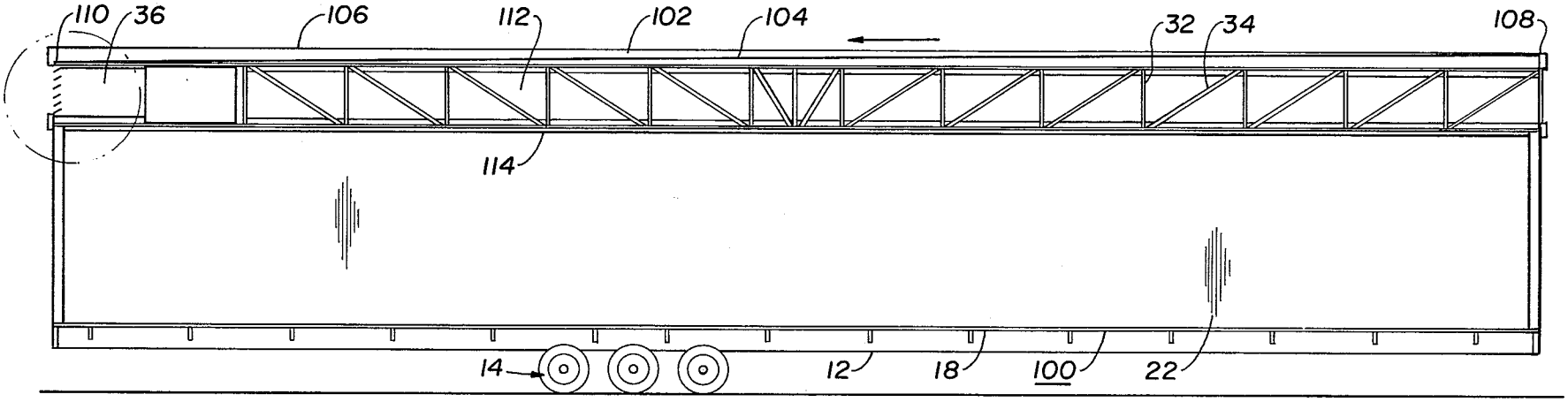
FIG. 5 shows a longitudinal elevational sideview, in section, of a second embodiment of a mobile modular building structure pursuant to the invention.
Figure 6:
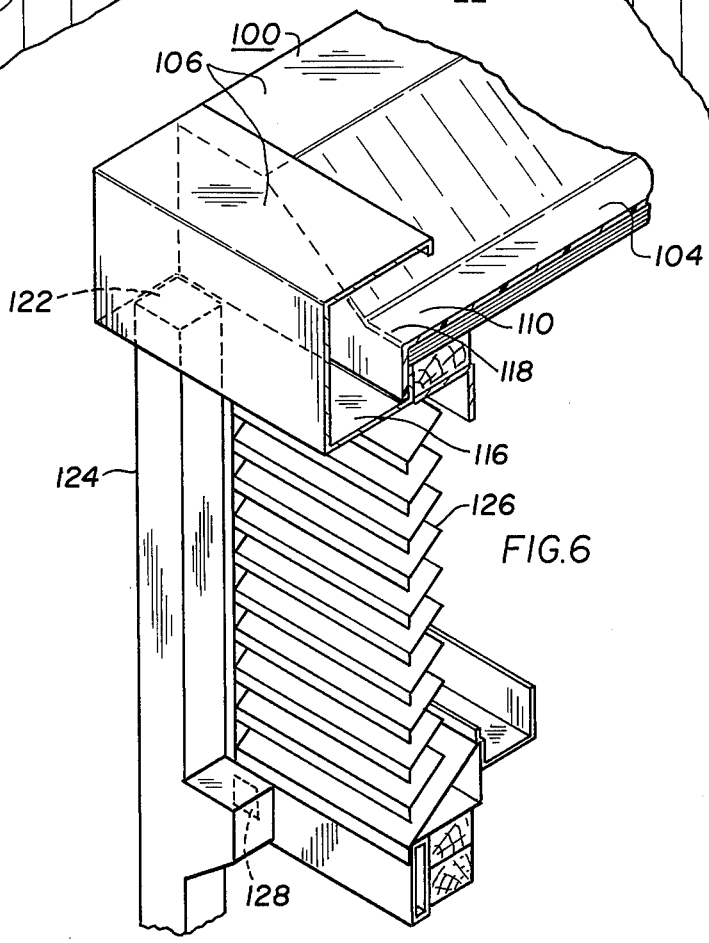
FIG. 6 shows an enlarged perspective view, partly in section, of the portion encircled in FIG. 5.

In the preferred embodiment of the invention shown in FIGS. 5 and 6 of the drawings, in which elements which are identical to those shown in FIGS. 1 through 4 are designated by the same reference numerals, a modular building structure 100 includes a roof 102. The roof 102 includes a generally planar upper roof surface 104 which may be constituted of plywood covered by a moisture-impervious plastic material, analogous to the construction described in connection with the embodiment of FIGS. 1 through 4.

In the present embodiment, the upper roof surface 104 is encompassed by parapets 106, the upper surface of which are generally horizontal so as to provide support for a similar modular building structure 104 which may be supported and fastened thereon.

The upper roof surface 104 slopes downwardly from the end 108 towards the longitudinally opposite end 110 of the modular building structure, preferably provided with a downward slope of about 4 inches over the entire length of the modular building structure.

Located in an interspace 112 between the roof 102 and a dropped ceiling 114 may be the necessary air conditioning, heating, power supply and utility components for the modular building structure. Preferably, such air conditioning supply, heating and power supply units should be located at the end of the modular building structure having the lower slope end portion of the roof 102, as shown in FIG. 5 of the drawings.

As shown in detail in FIG. 6 of the drawings, the lower end of the sloped roof structure is provided with a gutter 116 communicating with a trough 118 extending along the lower edge of the roof 102 so as to allow a drainage of water from the surface 104 into the gutter 116. The gutter 116 is formed by suitable shaped sheet metal elements 120 constituting a part of the parapet 106. Communicating with an aperture 122 in the gutter 116 is a downspout 124 for removal of liquids collecting in the gutter.

Suitable louvers 126 may also be provided at that particular end of the modular building structure 100 as to provide for ventilation for the components in the interspace 112. Additionally, drainage means for the heating and air conditioning components may communicate through a scupper 128 with the downspout 124.

By providing the foregoing arrangement having the slope always extending towards one end of the roof of the modular building structure 100, and locating the power supply, air conditioning, heating components and alike at that end, it is possible to join two such building modules in an end-to-end relationship, in which the adjoining ends are the high-sided ends of the roof and the open ends are the lower sloped or "utility ends", thereby providing adequate venting through the louvers 126 and ready accessibility to the components in the interspace 112 for the servicing thereof.

Additionally, the modular building structure of each of the embodiments shown in the drawings are adapted to be interconnected with other similar modular building structures in either end-to-end, side-by-side, or superimposed relationship, so as to afford an arrangement of modular building structures in conformance with any particular needs.

Furthermore, in an advantageous feature of the present invention, the gutters and downspouts of the modular building structures are formed within decorative metal facings employed on the finished buildings so as to provide advantages both from an aesthetic and functionality standpoint.

What is claimed is:

1. In a mobile modular building structure having a length, width and height, with ends being defined by the shorter dimensioned sides which extend the width of the structure, and sides being defined by the longer dimensioned sides which extend the length of the structure, including a floor portion; upstanding wall members; a generally horizontal roof structure which is substantially rectangular in configuration; and a ceiling extending below said horizontal roof structure defining a space therebetween, the improvement comprising; parapets extending along the upper external edge of said generally horizontal roof structure so as to form a depressed planar upper roof surface therebetween, said planar roof surface being sloped downwardly from a high-sided end thereof towards the opposite low-sided end of said roof structure so as to thereby provide at least one drainage flow passageway extending toward said low-sided end of said roof structure, a drainage gutter being formed along the lower end edge of said sloped roof surface, said parapet including portions covering said gutter and at least one downspout communicating with said gutter for drainage of liquids collected on said upper roof surface, electrical power and utility supply conduits, air conditioning, heating equipment and the like being arranged in said space between the ceiling and roof proximate the low-sided end of said planar roof structure, and vents being provided in the modular building structure proximate the utility equipment in said space in the low-sided end to provide the modular building structure the flexibility of being placed end to end with a second, similar building structure with the high-sided ends adjoining, whereby the open ends are always the low-sided ends having the utilities and vents therein.

2. A modular building structure as claimed in claim 1, said planar upper roof surface being a slope providing a 4-inch drop in elevation between the ends of said roof surface.

3. A modular building structure as claimed in claim 1, said parapets comprising shaped metal members, and said planar upper roof surface being constituted of a moisture-impervious plastic material.

4. A plurality of modular building structures as claimed in claim 1, and also being adapted to be arranged in side-by-side relationship.

5. A plurality of modular building structures as claimed in claim 1, and also being adapted to be arranged in superposed relationship.

6. A modular building structure as claimed in claim 1, said parapets and downspout being formed in decorative metal facings on said building structure.

* * * * *